United States Patent [19]

Hubert

[11] Patent Number: 4,572,493

[45] Date of Patent: Feb. 25, 1986

[54] UNIT HAVING DEGREES OF FREEDOM, SUCH AS A SURGICAL OPERATING TABLE

[75] Inventor: Jean Hubert, Paris, France

[73] Assignee: A L M, Le-Pre-Saint-Gervais, France

[21] Appl. No.: 623,331

[22] Filed: Jun. 22, 1984

[30] Foreign Application Priority Data

Jun. 30, 1983 [FR] France ..... 83 10828

[51] Int. Cl.[4] ..... A61G 13/00

[52] U.S. Cl. ..... 269/325

[58] Field of Search ..... 269/322-328; 5/63, 66-69; 254/9 C, 10 C

[56] References Cited

U.S. PATENT DOCUMENTS

| | | | |
|---|---|---|---|
| 2,217,783 | 10/1940 | Bell . | |
| 3,863,890 | 2/1975 | Ruffing | 254/10 C |
| 3,977,664 | 8/1976 | Mitchell et al. | 269/323 |
| 4,101,120 | 7/1978 | Seshima . | |
| 4,195,829 | 4/1980 | Reser | 269/325 |
| 4,474,364 | 10/1984 | Brendgord | 269/325 |

FOREIGN PATENT DOCUMENTS

| | | | |
|---|---|---|---|
| 2049282 | 4/1972 | Fed. Rep. of Germany . | |
| 2260140 | 6/1974 | Fed. Rep. of Germany . | |
| 941525 | 1/1949 | France . | |
| 1087795 | 2/1955 | France . | |
| 1108891 | 1/1956 | France . | |
| 910029 | 5/1960 | United Kingdom | 269/325 |

*Primary Examiner*—Robert C. Watson

*Attorney, Agent, or Firm*—Young & Thompson

[57] ABSTRACT

The unit may be a surgical operating table and has electric control devices. The unit comprises two identical electrically-operated jacks 14, 15 which are located at equal distances from a vertical plane containing an axis about which the platform 11 of the unit is pivotable in a transverse plane, the jacks exerting on a universal joint 8 connected to the platform forces of the same magnitude and in the same direction or in opposite directions, and a third electrically-operated jack and a pneumatic spring device disposed on opposite sides of that vertical plane.

12 Claims, 4 Drawing Figures

UNIT HAVING DEGREES OF FREEDOM, SUCH AS A SURGICAL OPERATING TABLE

The invention relates to a unit having multiple degrees of freedom, in particular a surgical operating table whose platform is mounted by means of a universal joint having perpendicular axes X—X', Y—Y' on a a stand which is movable in rotation and in translation about and along a vertical axis Z—Z', of the type comprising means for driving in rotation for the purpose of pivoting the universal joint about the axes X—X', Y—Y', and means for driving in translation for moving the stand along the axis Z—Z' so that it is possible to tilt the platform in the longitudinal and transverse directions and to adjust it in height.

Operating tables known at the present time which are of this type of unit are usually provided with two jacks which control separately the left-right transverse tilting on one hand, and the longitudinal upward-downward tilting on the other hand, these two jacks being respectively centered in the vertical plane containing the transverse tilting axis X—X' and in the vertical plane containing the longitudinal tilting axis Y—Y', and with a third raising and lowering jack.

These jacks must develop large forces for overcoming the resistant torques that they encounter for the transverse and longitudinal tilting movements, owing to their relative placement along each of the corresponding axes and owing to the weight of the patient. The magnitude of these forces requires jacks whose dimensions are liable to be incompatible with the restricted dimensions imposed on the stand for various reasons of overall size, convenience of access, and use of the table with other apparatus, for example radiological apparatus.

Another drawback of presently-known surgical operating tables provided with electrically operated jacks is that these jacks are connected to the electric mains circuit either by equipment integrated within the floor or by loose wires. Consequently, these tables require considerable foundation work and the rotation of the platform about the vertical axis Z—Z' must be limited, usually by abutments, which may require in some cases effecting pivotal movements in the opposite direction.

An object of the present invention is to overcome these various drawbacks and to propose for this purpose a unit, and more particularly a surgical operating table, in which the aforementioned means for driving in rotation comprise a pair of devices disposed on opposite sides of the vertical plane containing one of the aforementioned axes, for example the axis X—X', said devices being provided for exerting simultaneously on the universal joint forces in the same direction or in opposite directions.

The two driving devices therefore do not act separately, like the jacks of the prior art, each of which must develop sufficient force to overcome the resistant torques opposing its action, but act simultaneously for overcoming these torques, whether the forces exerted on the universal joint be in the same direction or the opposite direction. In this way, the overall size of these devices may be markedly reduced.

According to another feature of the invention, the means for driving in translation comprise associated elements one of which is capable of recovering a potential energy of gravity, these elements being provided for exerting on the stand forces of the same magnitude and the same direction for the rising movement and of opposite directions for the descending movement.

The combination of two associated elements results in a smaller overall size owing to the possibility of recovering energy.

According to another feature of the invention, the aforementioned pair of devices are formed by two electric jacks connected in parallel and disposed at equal distances from the plane containing the transverse tilting axis X—X' and arranged to exert on the universl joint forces of the same magnitude.

In this way, each of these jacks will only need to provide a force equal to one half of that which was required of the jacks of the prior art for overcoming the resistant torques, whether these jacks act in the same direction or in opposite directions.

According to a further feature of the invention, the aforementioned associated elements comprise an electric jack and a pneumatic spring device.

This spring device therefore exerts, when raising the platform, a vertical force which is substantially equal to one half of the total weight of the vertically movable part of the table, i.e. the stand, the platform and, as the case may be, the patient.

Consequently, as the jack has only to provide a force which is one half of that provided by the jacks of known tables, it can have an overall size which is substantially less than that of the jacks of said known tables.

Further, according to the invention, the electric systems for driving the jacks are supplied with current by an independent source of current mounted on a support associated with said stand.

Such an independent source enables the table to avoid the inconveniences resulting from the mains supply: there is no loose supply cable which is always a hinderance and it can be used easily either as a table having a fixed stand or as a table having a movable stand, and the platform can be rotated to an unlimited extent.

Further features and advantages of the invention will be apparent from the following description.

In the accompanying drawings, which show merely by way of example to which the scope of the invention is not intended to be limited, a surgical operating table according to the invention:

Figure 1:
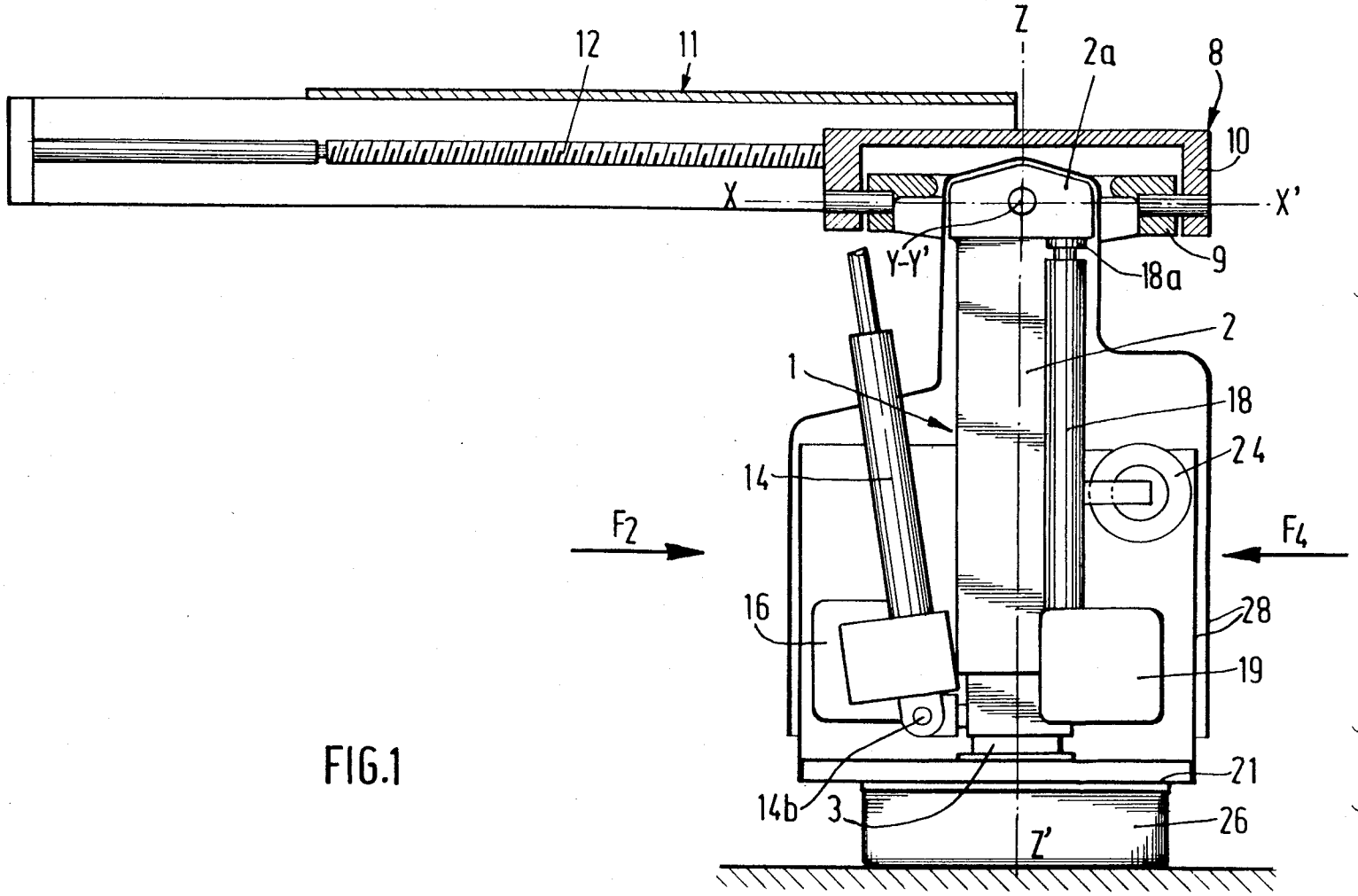
FIG. 1 is an elevational view of the table, partly in section.
Figure 2:
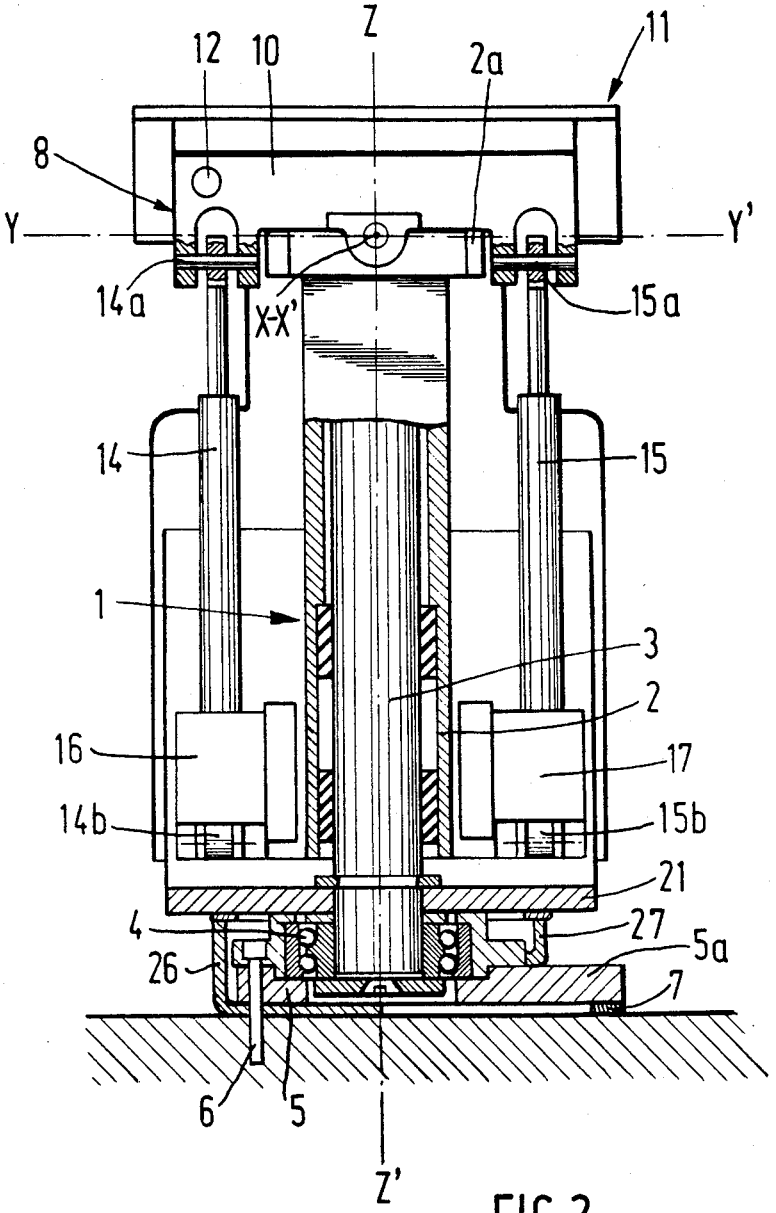
FIG. 2 is a partial sectional view of the table in the direction of arrow $F_2$ of FIG. 1.
Figure 3:
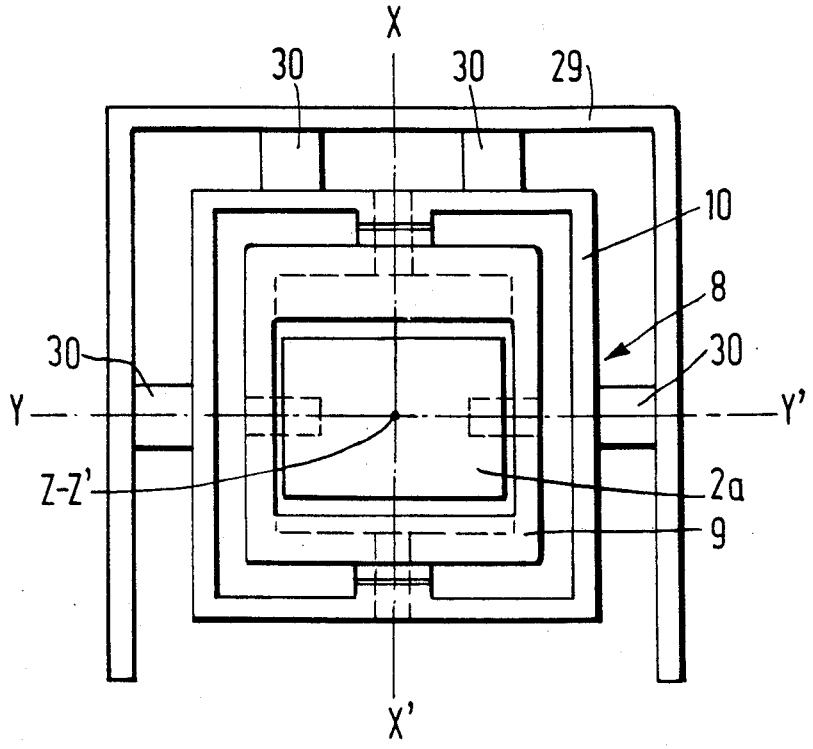
FIG. 3 shows the universal joint without the platform but provided with a handling frame.
Figure 4:
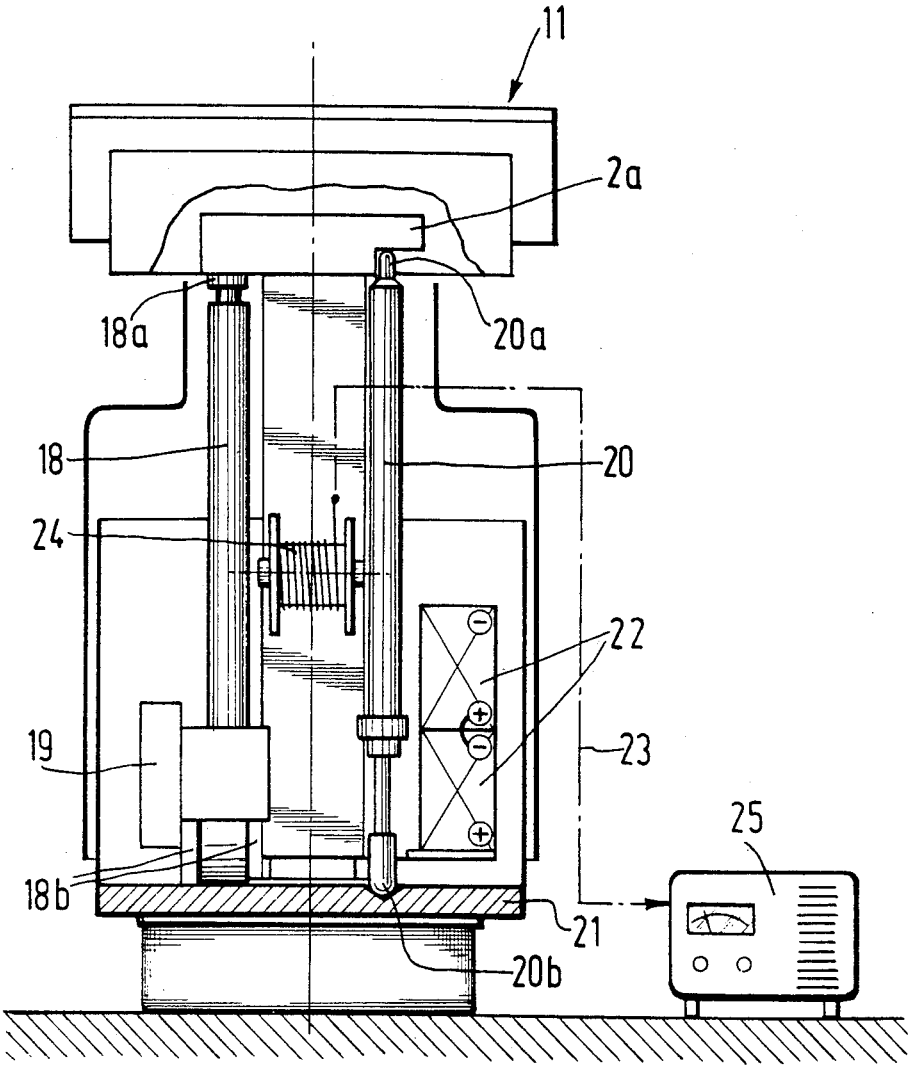
FIG. 4 shows, partly in section, the table as viewed in the direction of arrow $F_4$ of FIG. 1.

The table shown in FIGS. 1 to 4 comprises a stand 1 formed by a support 2 slidable along a vertical column 3 mounted on a ball-bearing pivot 4 so that the column and the support are rotatable about a vertical axis Z—Z'. According to the desired version, namely a fixed-station or a transferable table, the pivot 4 bears on a base 5 anchored in the floor by pins 6 (left half of FIG. 2) or on a base plate 5*a* which simply rests on the floor through a peripheral sealing element 7 which prevents the passage, under the stand, of dust which is incompatible with the aseptic conditions required of operating theatres (right half of FIG. 2).

Mounted on the head 2*a* provided in the upper part of support 2 is a universal joint 8 constituted by two cradles 9 and 10 which are pivotable about two intersecting perpendicular axes X—X′ and Y—Y′. This universal joint supports the slidable platform 11 provided for the patient and is provided for this purpose with a lead-screw 12 engaged in a nut (not shown).

The universal joint 8, and therefore the platform 11, is driven in rotation about the transverse tilting axis X—X′ and the longitudinal tilting axis Y—Y′ by identical jacks 14 and 15 which are mounted in parallel and pivotally connected at their two ends, on the one hand, to the cradle 10 at 14*a*, 15*a* and, on the other hand, to the support 2 at 14*b*, 15*b*, these ends being provided with ball joints which reduce frictional torque. The jacks 14 and 15 are each actuated by an electric motor system 16 and 17 consisting of an electric motor proper which may or may not be associated with a speed reducing-reversing device. These motor systems have a hermetic moulded case so as to satisfy present standards concerning risk of explosion in operating units. The two jacks 14 and 15 and their associated acutating systems 16 and 17 are located on opposite sides of the vertical plane containing the axis X—X′ and at equal distances from this plane.

The support 2 is driven vertically in translation along the column 3 by a jack 18 which bears, on one hand, through a thrust bearing or the like 18*a*, under the head 2*a* of the support 2 and, on the other hand, through spacer members 18*b*, on a fixed plate 21 which bears on the base 5 (or the base plate 5*a*, depending on the adopted version) through the pivot 4. The jack 18 is actuated, as are the jacks 14 and 15, by an electric motor system 19 identical to the systems 16 and 17 and having, as the latter, a moulded case. Associated with the jack 18 is a pneumatic spring device 20 whose upper end 20*a* is fixed by a pin under the head 2*a* of the support 2 and whose lower end 20*b* bears on the fixed plate 21. The jack 18 and the pneumatic spring device 20 are disposed on opposite sides of the vertical plane containing the transverse tilting axis X—X′ at equal distances from this plane and in opposed relation to the jacks 14 and 15 with respect to the vertical plane containing the longitudinal tilting axis Y—Y′.

The motor systems 16, 17 and 19 are supplied with electric current by an independent source of current formed by two low-voltage rechargeable batteries 22, for example 24-volt batteries. These batteries have sufficient capacity to ensure autonomous operation of the table for one operating day, thus affording the surgeon full safety. However, these batteries must be regularly recharged, usually outside the operating periods. For this purpose, they are connected to a charger 25 by an electric cable 23 which is wound around an automatic cable winder 24 mounted on the support 2. The length given to the cable 23 enables the charger to be placed outside the operating theatre if it is necessary to recharge the batteries in the course of an operating programme. The atmosphere of these theatres is indeed often charged with anaesthetic gases and any possibility of explosion due to electric sparks is thus avoided.

In order to avoid soiling of the various component parts of the table in the course of, for example, urological interventions, or soiling due to inevitable splashing of antiseptic products when cleaning the operating threatres, there are provided at the base of the stand 1 protective casings 26 (a fixed version is shown in the left half of FIG. 2) or protective casings 27 (a transferable version is shown in the right half of FIG. 2) and a sealed telescopic casing 28 covering all of said elements.

It may be required to shift the table and it may be advantageous to employ a transfer-trolley for this purpose. The stand 1 is then provided with a detachable frame 29 which is temporarily fixed to the universal joint 8 (FIG. 3) by pins 30 effected by clamping means (not shown).

The table operates in the following manner:

In order to drive the platform in rotation about the axis Y—Y′, i.e. in order to tilt it about this axis so that it is downwardly or upwardly inclined, the electric motor systems 16 and 17 are so actuated that the two jacks 14 and 15 act simultaneously in the same direction, i.e. that their rods are extended or retracted to the same extent. The two jacks then develop the same force, each being equal to one half of that required for overcoming the resistant torques.

For the purpose of driving the platform in rotation about the axis X—X′, namely to tilt it transversely to the right or left, the motor systems are so actuated that the jacks 14 and 15 act simultaneously but in opposite directions, i.e. one of the rods is extended while the other is retracted to the same extent. The two jacks then develop two forces of the same magnitude but of opposite sign, each of these forces being equal to one half of that required for overcoming the resistant torques.

In order to raise or lower the platform, the motor system 19 is so actuated that the rod of the jack 18 is extended or retracted, thereby moving the support 3 along the column 2. The combination of the spring device 20 with this jack permits storing in this spring device in the course of the descending movement an energy which results from the weight of the moving part and is restored in the course of the rising movement. The forces required of the jack and the spring device for a rising movement are substantially equal, each thereof being substantially equal to one half of that which would be required of the jack used alone.

The rotatable mounting of the column, together with the fact that the batteries 22 are integral therewith, permits an unlimited rotation of the platform about the axis Z—Z′ and thereby provides the surgeon with maximum convenience. A locking pedal (not shown) may of course be provided for fixing the platform in a chosen orientation.

It should be mentioned that it is always possible to change from the fixed version to the movable version, or from the movable version to the fixed version, of the table by replacing the base 5 with a base plate 5*a* or vice versa.

In order to shift the whole of the stand 1 by means of a transfer trolley usually employed for the platforms, the fork (not shown) of this trolley is engaged under the frame 29 and a downward operation of the stand then brings the lower part of the frame into contact with this fork, and then, owing to this contact, in pursuing the downward operation, the stand rises relative to the ground until an end-of-travel position is reached. The stand-trolley assembly can then be shifted and oriented as desired by the user.

Many modifications may be made in the described and illustrated embodiment without departing from the scope of the invention as defined in the claims.

Thus, for example, there may be employed for the spring device 20 a hydraulic or mechanical spring. The jacks, instead of being jacks employing ball bearings, may be provided with an anti-friction connection of another type, etc.

The application of the invention is not intended to be limited to surgical tables but may be extended to beds for patients, dentists' chairs, robot units, etc.

What is claimed is:

1. A unit having multiple degrees of freedom, comprising a stand movable in rotation and in translation relative to a vertical axis, a universal joint having a first pivot axis and a second pivot axis which is perpendicular to said first pivot axis, a platform mounted by said universal joint on said stand, means for driving in rotation connected to the universal joint for pivoting said universal joint about said first and second axes and thereby pivoting said platform in a longitudinal plane about said first axis and in a transverse plane about said second axis, and means for driving in translation connected to said stand for moving said stand along said vertical axis, said means for driving in rotation comprising a pair of devices disposed on opposite sides of a first vertical plane containing one of said first and second axes, said devices being arranged to exert simultaneously on said universal joint selectively forces in the same direction and forces in opposite directions, said pair of devices being located on the same side of a second vertical plane containing the other of said first and second axes, said pair of devices comprising two jacks which are mounted in parallel and located at equal distances from said second plane and exerting on said universal joint forces of the same magnitude.

2. A unit according to claim 1, wherein said means for driving in translation comprise associated elements, one of which elements is capable of recovering a potential energy derived from the effect of gravity, said elements being arranged to exert on said stand forces of the same magnitude and the same direction for raising said platform and of opposite directions for lowering said platform along said vertical axis.

3. A unit according to claim 1, wherein said jacks are jacks having ball bearings, and each jack is combined with an electric motor system for actuating the jack, said motor systems being capable simultaneously of actuating the jacks in the same direction and in opposite directions.

4. A unit according to claim 2, wherein said associated elements comprise a third jack and a spring device.

5. A unit according to claim 4, wherein said third jack is a jack having ball bearings and is combined with a third electric motor system for actuating said third jack, and said spring device is a pneumatic spring device.

6. A unit according to claim 1, wherein said stand comprises a vertical column and a support slidably mounted on said column, said devices being pivotally connected to said support, said column being mounted on a pivot so as to be capable of rotating through at least 360° about said vertical axis.

7. A unit according to claim 5, wherein said pair of devices comprise jacks and electric motor systems for actuating said jacks selectively in the same direction and in opposite directions, said stand comprises a vertical column and a support slidably mounted on said column, said jacks of said pair of devices being pivotally connected to said support, said column being mounted on a pivot so as to be capable of rotating through at least 360° about said vertical axis, and an independent source of current mounted on said support being connected to said electric motor systems for supplying current thereto.

8. A unit according to claim 7, comprising a cable winding device mounted on said support, an electric cable wound around said winding device, and a charger for recharging said source connected to said source by said electric cable.

9. A unit according to claim 1, comprising a detachable frame for assembly with said universal joint for a handling of said platform by a transfer trolley.

10. A unit according to claim 1, said one of said first and second axes being horizontal.

11. A unit according to claim 1, which is a surgical operating table.

12. A unit according to claim 1, said platform being elongated in one horizontal direction away from said vertical axis, the longitudinal sides of said platform being disposed in parallel vertical planes between which said jacks are disposed.

* * * * *